United States Patent [19]

Jin

[11] 4,253,883

[45] Mar. 3, 1981

[54] FE-CR-CO PERMANENT MAGNET ALLOY AND ALLOY PROCESSING

[75] Inventor: Sungho Jin, Meyersville, N.J.

[73] Assignee: Bell Telephone Laboratories, Incorporated, Murray Hill, N.J.

[21] Appl. No.: 92,941

[22] Filed: Nov. 9, 1979

Related U.S. Application Data

[63] Continuation of Ser. No. 924,138, Jul. 13, 1978, abandoned.

[51] Int. Cl.[3] ..... H01F 1/02

[52] U.S. Cl. ..... 148/103; 148/108; 148/31.57

[58] Field of Search ..... 148/102, 103, 108, 31.57; 75/126 H

[56] References Cited

U.S. PATENT DOCUMENTS

| | | | |
|---|---|---|---|
| 3,806,336 | 4/1974 | Kaneko et al. | 75/126 H |
| 3,954,519 | 5/1976 | Inoue | 148/121 |
| 3,982,972 | 9/1976 | Iwata et al. | 148/121 |
| 3,989,556 | 11/1976 | Iwata et al. | 148/121 |
| 4,075,437 | 2/1978 | Chin et al. | 75/126 H |
| 4,120,704 | 10/1978 | Anderson | 148/103 |

*Primary Examiner*—L. Dewayne Rutledge
*Assistant Examiner*—John P. Sheehan
*Attorney, Agent, or Firm*—Peter A. Businger; Peter V. D. Wilde

[57] ABSTRACT

Fine-grained Fe-Cr-Co magnetic alloys are disclosed which have desirable magnetic properties such as, in particular, a coercive force in the range of 300–600 Oersted, a remanence in the range of 8000–13000 Gauss, and a maximum energy product in the range of 1–6 MGOe. Disclosed alloys consist essentially of 25–29 weight percent Cr, 7–12 weight percent Co, and remainder iron; processing of disclosed alloys may typically include low-temperature solution annealing, cold shaping, and an aging heat treatment. Disclosed magnetic alloys may be used, e.g., in the manufacture of ringers, relays, and electro-acoustic transducers.

17 Claims, 3 Drawing Figures

900° C X100

1300° C X100

FE-CR-CO PERMANENT MAGNET ALLOY AND ALLOY PROCESSING

CROSS-REFERENCE TO RELATED APPLICATIONS

This application is a continuation of application Ser. No. 924,138, filed July 13, 1978, now abandoned.

TECHNICAL FIELD

The invention is concerned with magnetic materials.

BACKGROUND OF THE INVENTION

Magnetic materials suitable for use in relays, ringers, and electro-acoustic transducers such as loudspeakers and telephone receivers characteristically exhibit high values of magnetic coercivity, remanence, and energy product.

Among established alloys having suitable magnetic properties are Al-Ni-Co-Fe and Cu-Ni-Fe alloys which are members of a group of alloys considered to undergo spinodal decomposition resulting in a fine-scale two-phase microstructure. Recently, alloys containing Fe, Cr and Co have been investigated with regard to potential suitability in the manufacture of permanent magnets. Specifically, certain ternary Fe-Cr-Co alloys are disclosed in H. Kaneko et al, "New Ductile Permanent Magnet of Fe-Cr-Co Systems", *AIP Conference Proceedings* No. 5, 1972, p. 1088, and in U.S. Pat. No. 3,806,336, "Magnetic Alloys". Quaternary alloys containing ferrite forming elements such as, e.g., Ti, Al, Si, Nb, or Ta in addition to Fe, Cr, and Co are disclosed in U.S. Pat. No. 3,954,519, "Iron-Chromium-Cobalt Spinodal Decomposition Type Magnetic Alloy Comprising Niobium and/or Tantalum", in U.S. Pat. No. 3,989,556, "Semihard Magnetic Alloy and a Process for the Production Thereof", in U.S. Pat. No. 3,982,972, "Semihard Magnetic Alloy and a Process for the Production Thereof", and in U.S. Pat. No. 4,075,437, "Composition, Processing, and Devices Including Magnetic Alloy".

The use of ferrite forming elements such as, e.g., Ti, Al, Si, Nb or Ta in quaternary alloys has been advocated, especially at higher Co levels or in the presence of impurities such as, e.g., C, N, or O, to facilitate production of a preliminary fine-grained alpha phase structure by low-temperature annealing.

SUMMARY OF THE INVENTION

The invention is an essentially ternary Fe-Cr-Co magnetic alloy whose grain size is sufficiently fine to result in at least B 3000 grains per $mm^3$ and which has a coercive force in the range of 300–600 Oersted, a remanence in the range of 8000–13000 Gauss, and a maximum magnetic energy product in the range of 1–6 MGOe. The alloy consists essentially of 25–29 weight percent Cr, 7–12 weight percent Co, and remainder Fe and may be conveniently produced, e.g., by a process involving solution annealing at a temperature in the range of 650–1000 degrees C. to produce a fine-grained, essentially single phase alpha structure, followed by cold forming and aging. Magnets made from such alloys may be used, e.g., in electro-acoustic transducers such as loudspeakers and telephone receivers, in relays, and in ringers.

DETAILED DESCRIPTION

In accordance with the invention it has been realized that Fe-Cr-Co alloys containing Cr in a preferred range of 25–29 weight percent, Co in a preferred range of 7–12 weight percent, and remainder essentially Fe can be produced so as to simultaneously have a maximum energy product in the range of 1–6 MGOe and a grain size corresponding to at least 3000 grains per $mm^3$, such grain structure being particularly beneficial when the alloy is to be cold shaped. A more narrow range of Cr content may be preferred and, specifically, in the interest of optimizing alloy formability, an upper limit of 28 weight percent and, in the interest of optimizing magnetic properties, a lower limit of 26 weight percent Cr may be preferred.

Alloys of the invention may be prepared, e.g., by casting from a melt of constituent elements Fe, Cr and Co or their alloys in a crucible or furnace such as, e.g., an induction furnace. Alternatively, a metallic body having a composition within the specified range may be prepared by powder metallurgy. Preparation of an alloy and, in particular, preparation by casting from a melt calls for care to guard against inclusion of excessive amounts of impurities as may originate from raw materials, from the furnace, or from the atmosphere above the melt. If such care is taken and, in particular, if sufficient care is taken to minimize the presence of impurities such as, e.g., nitrogen, addition of ferrite forming elements may be dispensed with. To minimize oxidation or excessive inclusion of nitrogen, it is desirable to prepare a melt with slag protection, in a vacuum, or in an inert atmosphere such as, e.g., an argon atmosphere. Levels of specific impurities are preferably kept below 0.05 weight percent C, 0.05 weight percent N, 0.2 weight percent Si, 0.5 weight percent Mg, 0.1 weight percent Ti, 0.5 weight percent Ca, 0.1 weight percent Al, 0.5 weight percent Mn, 0.05 weight percent S, and 0.05 weight percent O.

Figure 1:
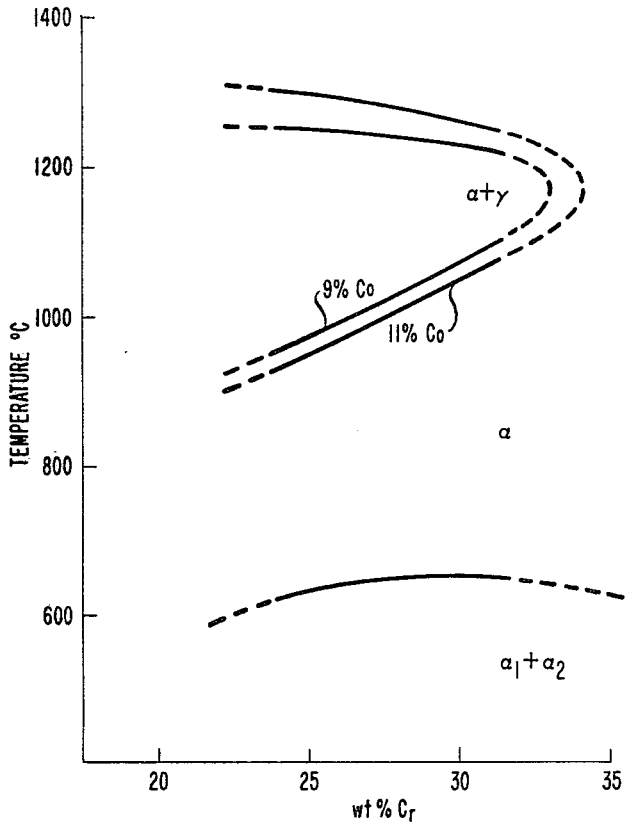
FIG. 1 shows phase diagrams of two Fe-Cr-Co alloy systems containing 9 weight percent Co and 11 weight percent Co, respectively.

Typical processing of the alloy after casting is as follows. The alloy is soaked at a temperature at which the alloy is in a two-phase, alpha plus gamma state for a period of 1–10 hours, temperatures in the range of 1100–1300 degrees C. being generally appropriate for this purpose. More specific preferred limits on such temperature corresponding to alloys containing, respectively, 9 weight percent Co and 11 weight percent Co can be obtained from FIG. 1. The alloy is then hot worked in such two-phase state, e.g., by hot rolling, forging, or extruding to break down the as-cast structure and, if desired, the alloy may be shaped by cold working. In order to develop a uniformly fine grain structure, the alloy is then solution annealed at a temperature at which the alloy is in an essentially single-phase alpha state and which generally is in the range of 650–1000 degrees C. Preferred upper limits on annealing temperature for specific alloys may be conveniently obtained by approximate linear interpolation between the following values: 950 degrees C. for an alloy containing 25 weight percent Cr and 7 weight percent Co, 875 degrees C. for an alloy containing 25 weight percent Cr and 12 weight percent Co, 1100 degrees C. for an alloy containing 29 weight percent Cr, and 7 weight percent Co, and 975 degrees C. for an alloy containing 29 weight percent Cr and 12 weight percent Co and are further required not to exceed 1000 degrees C. in the interest of minimization of grain growth. In the interest of improved kinetics, a lower limit of 800 degress C. is preferred and, in the interest of minimizing gamma phase, preferred upper limits are obtained by approximate linear interpolation between respective values of 925 degrees C., 850 degrees C., 1075 degrees C., and 950 degrees C. and also under the further provision that annealing temperature not exceed 1000 degrees C.

If the alloy has been cold worked, solution annealing so as to substantially recrystallize and homogenize the alloy may take from 10 minutes to 2 hours depending on annealing temperature and size of ingot. More typically, time required is in the range of 30–90 minutes. Solution annealing may be performed in air or, in the interest of minimizing surface oxidation, under exclusion of oxygen.

Figure 2:
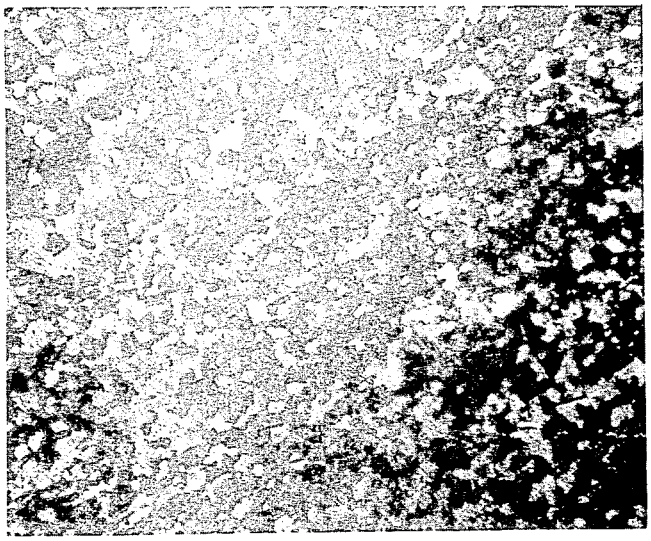
FIG. 2 is a photomicrograph showing grain structure, magnified 100 times, of an Fe-Cr-Co magnetic alloy containing 28 percent Cr and 11 weight percent Co which was solution annealed at 900 degrees C.
Figure 3:
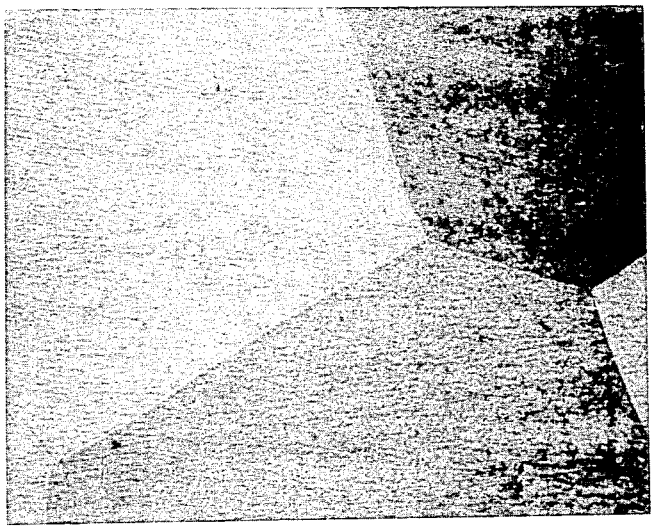
FIG. 3 is a photomicrograph showing grain structure, magnified 100 times, of an Fe-Cr-Co magnetic alloy containing 28 weight percent Cr and 11 weight percent Co which was solution annealed at 1300 degrees C.

Solution annealing is terminated by rapid quenching, e.g., by water or brine quenching, or, in the case of thin strips, by air quenching and preferably so as to result in a cooling rate of at least 1000 degrees C./min. throughout the alloy. At this point, the alloy is at or near room temperature, i.e., at a temperature which does not exceed 100 degrees C., and has an essentially uniformly fine grain size not exceeding 70 micrometers (corresponding to at least 3000 grains per $mm^3$). Such grain structure is illustrated by FIG. 2 and may be contrasted with the coarse structure obtained by annealing at elevated temperature as illustrated by FIG. 3.

At a temperature not exceeding 100 degrees C., the alloy may then be cold formed, e.g., by bending, wire drawing, deep drawing, or swagging. Particular benefits are derived from the fine-grained structure if the alloy is to be cold formed by wire drawing, deep drawing, or bending, i.e., by a technique which causes at least local tensile deformation. On account of the uniformly fine grain structure of the alloy as annealed and quenched, drawing may be by an amount corresponding to an essentially cross-sectional area reduction of at least 50 percent. Similarly, bending may result in a change of direction of at least 30 degrees, the resulting radius of curvature being such that it does not exceed a value which is proportional to the change in direction, which for a 30 degree change of direction is equal to the thickness of the part being bent, and which for a 90 degree change of direction is equal to 4 times the thickness of the part being bent.

Processing as described above characteristically comprises a step of maintaining the alloy at a temperature corresponding to an essentially single phase alpha state. Alternate processing so characterized may be, e.g., by hot working with finishing temperature in an essentially single phase alpha range, cooling, and forming. Moreover, forming may be carried out in stages with the intermediary additional solution annealing and quenching. Additional processing steps such as e.g., machining by drilling, turning, or milling before or after forming are not precluded.

The shaped alloy is finally subjected to an aging treatment to develop magnetic hardening. Such aging treatment may follow any of a variety of schedules as disclosed, e.g., in U.S. Pat. No. 4,075,437 and in U.S. patent application Ser. No. 924,137, filed July 13, 1978 in the names of G. Y. Chin et al which allow the production of magnets having magnetic remanence of 8000–13000 Gauss, magnetic coercivity of 300–600 Oersted, and magnetic energy product of 1–6 million Gauss-Oersted. Accordingly, such alloys may serve, upon magnetization in a magnetic field, as magnets in relays, ringers, and electro-acoustic transducers such as loudspeakers and telephone receivers.

In the following examples, phase structure and grain size were determined by X-ray diffraction analysis, hardness measurements, and metallographic analysis of microstructure after solution annealing and quenching, but before cold shaping. Average grain size was in the range of 25–40 micrometers as shown in Table I. Also shown in Table I are magnetic remanence $B_r$, coercivity $H_c$, and energy product $(BH)_{max}$ determined after aging of the alloys.

EXAMPLE 1

An ingot of an alloy containing 26.8 weight percent Cr, 9.4 weight percent Co, and balance essentially Fe was cast from a melt. Ingot dimensions were a thickness of 1.25 inches, a width of 5 inches, and a length of 12 inches. The cast ingot was heated to a temperature of 1250 degrees C., hot rolled into a quarter inch plate, and water cooled. Sections of the plate were cold rolled at room temperature into strips having a thickness of 0.1 inches and a width of 0.625 inches. The strips were annealed at 900 degrees C. for 30 minutes and water cooled. The strips were reheated to 630 degrees C., maintained at this temperature for 1 hour, cooled at an essentially constant rate of 15 degrees C./h to a temperature of 555 degrees C., maintained at 540 degrees C. for 3 hours, and maintained at 525 degrees C. for 4 hours.

EXAMPLE 2

Strips of an alloy containing 27.7 weight percent Cr, 10.9 weight percent Co, and balance essentially Fe were prepared by casting, hot working, quenching, solution annealing, cooling, and rolling as described in Example 1. The strips were reheated to 635 degrees C., maintained at this temperature for 3 minutes, cooled at an essentially constant rate of 15 degrees C./h to 555 degrees C., maintained at 540 degrees C. for 3 hours and maintained at 525 degrees C. for 4 hours.

EXAMPLE 3

Strips of an alloy containing 27.3 weight percent Cr, 7.2 weight percent Co, and balance essentially Fe, were prepared as described in Example 1. The strips were reheated to 620 degrees C., maintained at this temperature for 1 hour, cooled at an essentially constant rate of 15 degrees C./h to 555 degrees C., maintained at 555 degrees C. for 2 hours, at 540 degrees C. for 3 hours, and at 525 degrees C. for 16 hours.

EXAMPLE 4

Strips of an alloy containing 26.8 weight percent Cr, 10.6 weight percent Co, and balance essentially Fe were prepared as described in Example 1. The strips were soft and ductile and could readily be bent in any direction by 90 degrees over a sharp edge having a radius of curvature of 1/32 of an inch or drawn so as to result in 99 percent area reduction. Strips were aged according to a schedule disclosed in U.S. patent application Ser. No. 924,137, filed July 13, 1978 in the names of G. Y. Chin et al by maintaining the alloy at a temperature of 680 degrees C. for 30 minutes, rapidly cooling at a first rate of 140 degrees C./h to 615 degrees C., and then cooling at exponentially decreasing rates of 20–2 degrees C./h to a temperature of 525 degrees C.

EXAMPLE 5

0.7 inch diameter rods of an alloy containing 27.9 weight percent Cr, 10.7 weight percent Co, and balance Fe were prepared by casting, hot working, solution annealing, and quenching. The rods were cold drawn to 0.07 inch diameter wire (having 99 percent reduced cross-sectional area), solution annealed at 930 degrees C. for 30 minutes, and cooled to room temperature. An aging heat treatment was carried out by maintaining the drawn wire for 30 minutes at 700 degrees C., cooling to 615 degrees C. at a rate of 30 degrees C./h in a magnetic field of 1000 Oersted, and cooling to a temperature of 480 degrees C. at exponentially decreasing rates of 20–2 degrees C./h.

TABLE I

| Ex. | Cr Wt. % | Co Wt. % | Grain Size μm | $B_r$ G | $H_c$ Oe | (BH) max MGOe |
|---|---|---|---|---|---|---|
| 1 | 26.8 | 9.4 | 30 | 10010 | 380 | 1.55 |
| 2 | 27.7 | 10.9 | 25 | 9750 | 400 | 1.72 |
| 3 | 27.3 | 7.2 | 40 | 9280 | 300 | 1.10 |
| 4 | 26.8 | 10.6 | 40 | 10010 | 370 | 1.76 |
| 5 | 27.9 | 10.7 | 30 | 12750 | 570 | 5.03 |

I claim:

1. Method for producing a magnetic element comprising a body of an alloy consisting of 25–29 weight percent Cr, 7–12 weight percent Co, and remainder Fe CHARACTERIZED IN THAT said method comprises the steps of (1) subjecting said body to an annealing temperature which is such that, (a) said annealing temperature is greater than or equal to 650 degrees C., (b) said annealing temperature is less than or equal to a temperature which is obtained by approximate linear interpolation between a temperature of 950 degrees C. corresponding to an alloy comprising 25 weight percent Cr and 7 weight percent Co, a temperature of 875 degrees C. corresponding to an alloy comprising 25 weight percent Cr and 12 weight percent Co, a temperature of 1100 degrees C. corresponding to an alloy comprising 29 weight percent Cr and 7 weight percent Co and a temperature of 975 degrees C. corresponding to an alloy comprising 29 weight percent Cr and 12 weight percent Co, (c) said annealing temperature is less than or equal to 1000 degrees C. whereby an average grain size not exceeding 70 micrometers is obtained in said alloy, (2) forming said body into a desired shape at a temperature not exceeding 100 degrees C. either by wire drawing or deep drawing by an amount corresponding to a cross-sectional area reduction of at least 50 percent or by deep drawing or bending so as to result in a change of direction of at least 30 degrees, the resulting radius of curvature being such that it does not exceed a value which is proportional to change in direction, which for a 30 degree change in direction is equal to the thickness of the part being bent, and which for a 90 degree change of direction is equal to 4 times the thickness of the part being bent, and (3) aging said alloy.

2. Method of claim 1 in which step (1) is effected by solution annealing.

3. Method of claim 1 in which step (1) is effected by hot working terminating at said annealing temperature.

4. Method of claim 1 in which the annealing temperature is such that (a) said annealing temperature is greater than or equal to 800 degrees C., (b) said annealing temperature is less than or equal to a temperature which is obtained by approximate linear interpretation between a temperature of 925 degrees C. corresponding to an alloy comprising 25 weight percent Cr and 7 weight percent Co, a temperature of 850 degrees C. corresponding to an alloy comprising 25 weight percent Cr and 12 weight percent Co, a temperature of 1075 degrees C. corresponding to an alloy comprising 29 weight percent Cr and 7 weight percent Co and a temperature of 950 degrees C. corresponding to an alloy comprising 29 weight percent Cr and 12 weight percent Co and (c) said annealing temperature is less than or equal to 1000 degrees C.

5. Method of claim 1 in which said alloy is prepared from a melt.

6. Method of claim 5 in which said melt is prepared in a vacuum or in an inert atmosphere or under slag protection.

7. Method of claim 1 in which said alloy, prior to step (1), is soaked at a temperature in the range of 1100–1300 degrees C.

8. Method of claim 7 in which said alloy, after soaking and prior to step (1), is hot worked at a temperature in the range of 1100–1300 degrees C.

9. Method of claim 8 in which said alloy, after hot working and prior to step (1), is cold worked.

10. Method of claim 1 in which forming is carried out in stages with additional intermediate solution annealing and quenching.

11. Method of claim 1 in which aging is by cooling at an essentially constant rate.

12. Method of claim 1 in which aging is by cooling at a first, rapid average rate followed by cooling at a second, slower average rate.

13. Method of claim 1 in which aging is carried out in the presence of a magnetic field.

14. Method of claim 1 in which said body is machined after step (1) and prior to step (2).

15. Method of claim 1 in which said body is machined after step (2) and prior step (3).

16. Article of manufacture comprising a body of a magnetic alloy consisting of 25–29 weight percent Cr, 7–12 weight percent Co, and remainder Fe and having at least 3000 grains per $mm^3$ and a coercive force in the range of 300–600 Oersted, a remanence in the range of 8000–13000 Gauss, and a magnetic energy product in the range of 1–6 MGOe.

17. Article of claim 16 in which said alloy contains 26–28 weight percent Cr.

* * * * *